US006852629B2

(12) United States Patent
Kane et al.

(10) Patent No.: US 6,852,629 B2
(45) Date of Patent: Feb. 8, 2005

(54) BACKSIDE INTEGRATED CIRCUIT DIE SURFACE FINISHING TECHNIQUE AND TOOL

(75) Inventors: Terence Kane, Wappingers Falls, NY (US); Darrell L. Miles, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/751,758

(22) Filed: Jan. 5, 2004

(65) Prior Publication Data

US 2004/0137738 A1 Jul. 15, 2004

Related U.S. Application Data

(62) Division of application No. 09/734,225, filed on Dec. 11, 2000.

(51) Int. Cl.[7] ..... H01L 21/302; H01L 21/461

(52) U.S. Cl. ..... 438/690; 438/797

(58) Field of Search ..... 438/14, 15, 16, 438/18, 115, 690, 796, 797

(56) References Cited

U.S. PATENT DOCUMENTS

| | | | | |
|---|---|---|---|---|
| 4,075,044 A | * | 2/1978 | Jager et al. | 438/7 |
| 5,273,940 A | | 12/1993 | Sanders | |
| 5,424,224 A | * | 6/1995 | Allen et al. | 438/472 |
| 5,635,083 A | | 6/1997 | Breivogel et al. | |
| 5,653,622 A | | 8/1997 | Drill et al. | |
| 5,698,474 A | | 12/1997 | Hurley | |
| 5,817,179 A | * | 10/1998 | Choi et al. | 118/728 |
| 5,868,896 A | | 2/1999 | Robinson et al. | |
| 5,916,009 A | | 6/1999 | Izumi et al. | |
| 5,925,576 A | | 7/1999 | Peng | |
| 5,941,758 A | | 8/1999 | Mack | |
| 6,263,566 B1 | | 7/2001 | Hembree et al. | |
| 6,375,549 B1 | * | 4/2002 | Glashauser et al. | 451/41 |
| 6,375,550 B1 | * | 4/2002 | Berman | 451/41 |
| 6,559,670 B1 | * | 5/2003 | Motamedi | 324/765 |

FOREIGN PATENT DOCUMENTS

| | | |
|---|---|---|
| JP | 9270398 A | 10/1997 |
| JP | 10076461 | 3/1998 |

OTHER PUBLICATIONS

T. Kane, K. DeVries, M. Tenney, A. Patel, *Characterization and Fault Identification of Copper BEOL sub 0.25μm Six Level Metal Microprocessor Designs*; IBM Advanced Semiconductor Technology Center, pp. 1–6.

Moyra McManus, Bill Huott, Pia Sanda, Steven Steen, Dan Knebel, Denis Manzer, Steve Wilson, Tony Pelella, Yuen Chan, Stas Polonsky: *Picosecond Imaging Circuit Analysis of the IBM G6*; IBM T.J. Watson Research Center, IBM S/390 Division, pp. 1–4.

* cited by examiner

*Primary Examiner*—Phuc T. Dang
(74) *Attorney, Agent, or Firm*—DeLio & Peterson, LLC; Kelly M. Reynolds; Lisa U. Jacklitsch

(57) ABSTRACT

A method for preparing a semiconductor die for analysis comprises providing a semiconductor die having a connector on one side and an opposite, backside surface to be analyzed, providing a polishing pad for polishing the backside surface of a semiconductor die, providing a rotatable spindle for securing the polishing pad, and providing a constant force actuator on the spindle, the constant force actuator being adapted to provide constant force between the polishing pad and the backside surface of the die. The method then includes contacting the backside die surface with the polishing pad, rotating the spindle and polishing pad, and polishing the backside surface of the die while maintaining the substantially constant force of the polishing pad on the die backside surface with the constant force actuator.

23 Claims, 2 Drawing Sheets

BACKSIDE INTEGRATED CIRCUIT DIE SURFACE FINISHING TECHNIQUE AND TOOL

BACKGROUND OF THE INVENTION

1. Field of the Invention

This invention relates to the manufacturing of integrated circuits and, in particular, to the surface finishing of integrated circuit die surfaces prior to emission analysis.

2. Description of Related Art

Microprocessor chips or dies are made from semiconductor wafers and contain numerous integrated circuits. Various methods are used for the identification, redesign and process improvements to functioning and non-functioning integrated circuits. These methods include functional characterization of logic integrated circuits for design debug, earlier hardware functionality, reliability qualification assurance, and manufacturing yield learning analysis. Such methods require backside emission microscopy, laser optical beam induced current (OBIC), light induced voltage alteration (LIVA), and picosecond image circuit analysis (PICA). Backside emission microscopy involves detecting photons of light from the recombination and relaxation of electrons and holes, typically during semiconductor failure modes. Common techniques to improve infrared wavelength signal of photons emitted from electron-hole pairs of device junctions is to backside thin substrate of silicon to minimized scattering effects of implant dopant concentrations. A tool and process for machining the backside of a silicon semiconductor for backside emission microscope detection is disclosed in U.S. Pat. No. 5,698,474, the disclosure of which is hereby incorporated by reference.

Current techniques use numerical controlled milling machine followed by various methods of hand polishing, chemical-mechanical polishing (CMP) slurries, wet etching, all aimed to remove machine milling marks and scratches. These techniques are unsatisfactory due to the irregularities in hand polishing or hand held machine surface polishing, and to deficiencies in the slurries associated with chemical-mechanical polishing. The problems are exacerbated by the size of the microprocessor chip or die surface, which may be greater than 15 mm by 15 mm, and up to 30 mm by 30 mm or more.

Bearing in mind the problems and deficiencies of the prior art, it is therefore an object of the present invention to provide a method of polishing a wafer which provides a surface finish which is uniformly planar.

Another object of the present invention is to provide an improved method and tool for removing milling machine marks from die surfaces.

A further object of the invention is to provide a faster time interval for polishing a silicon wafer.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a method for preparing a semiconductor die for analysis. The method comprises providing a semiconductor die having a connector on one side and an opposite, backside surface to be analyzed, providing a polishing pad for polishing the backside surface of a semiconductor die, providing a rotatable spindle for securing the polishing pad, and providing a constant force actuator on the spindle, the constant force actuator being adapted to provide constant force between the polishing pad and the backside surface of the die. The method then includes contacting the backside die surface with the polishing pad, rotating the spindle and polishing pad, and polishing the backside surface of the die while maintaining the substantially constant force of the polishing pad on the die backside surface with the constant force actuator.

In another aspect, the present invention provides a method for polishing a semiconductor surface comprising providing a semiconductor having a surface to be polished, providing a polishing pad for polishing the semiconductor surface, and providing a rotatable spindle for securing the polishing pad. The method includes applying a constant force from the spindle to the polishing pad and urging the polishing pad against the semiconductor surface, rotating the spindle and polishing pad, and polishing the semiconductor surface of the die while maintaining the substantially constant force of the polishing pad on the die backside surface with the constant force actuator.

The backside of the die preferably comprises silicon, and the polishing removes portions of the silicon. The backside of the die may also contain silicon oxide, silicon nitride, and/or silicon germanium. Prior to polishing the die backside with the polishing pad, the method preferably includes milling the die backside to remove a desired thickness of the die. The method may further include analyzing the polished backside of the die by emission microscopy.

Preferably, the spindle and polishing pad are rotated at a speed of about 500 to 200 rpm during polishing, and the polishing pad is resilient and deformed during polishing. The method may also include applying a non-reactive slurry between the polishing pad and the die surface during polishing. Preferably, the semiconductor die is secured in a stationary position in a fixture.

In a further aspect, the present invention provides a tool for polishing a semiconductor die comprising a polishing pad for polishing a surface of a semiconductor die, a spindle for securing the polishing pad to a distal end thereof, a constant force actuator on the spindle, the constant force applicator being adapted to provide constant force between the polishing pad and a surface of the die, and a chuck for rotating the spindle.

Preferably, the constant force actuator comprises a spring maintained in compression between the spindle and the polishing pad. The polishing pad is preferably resilient and deformable during polishing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
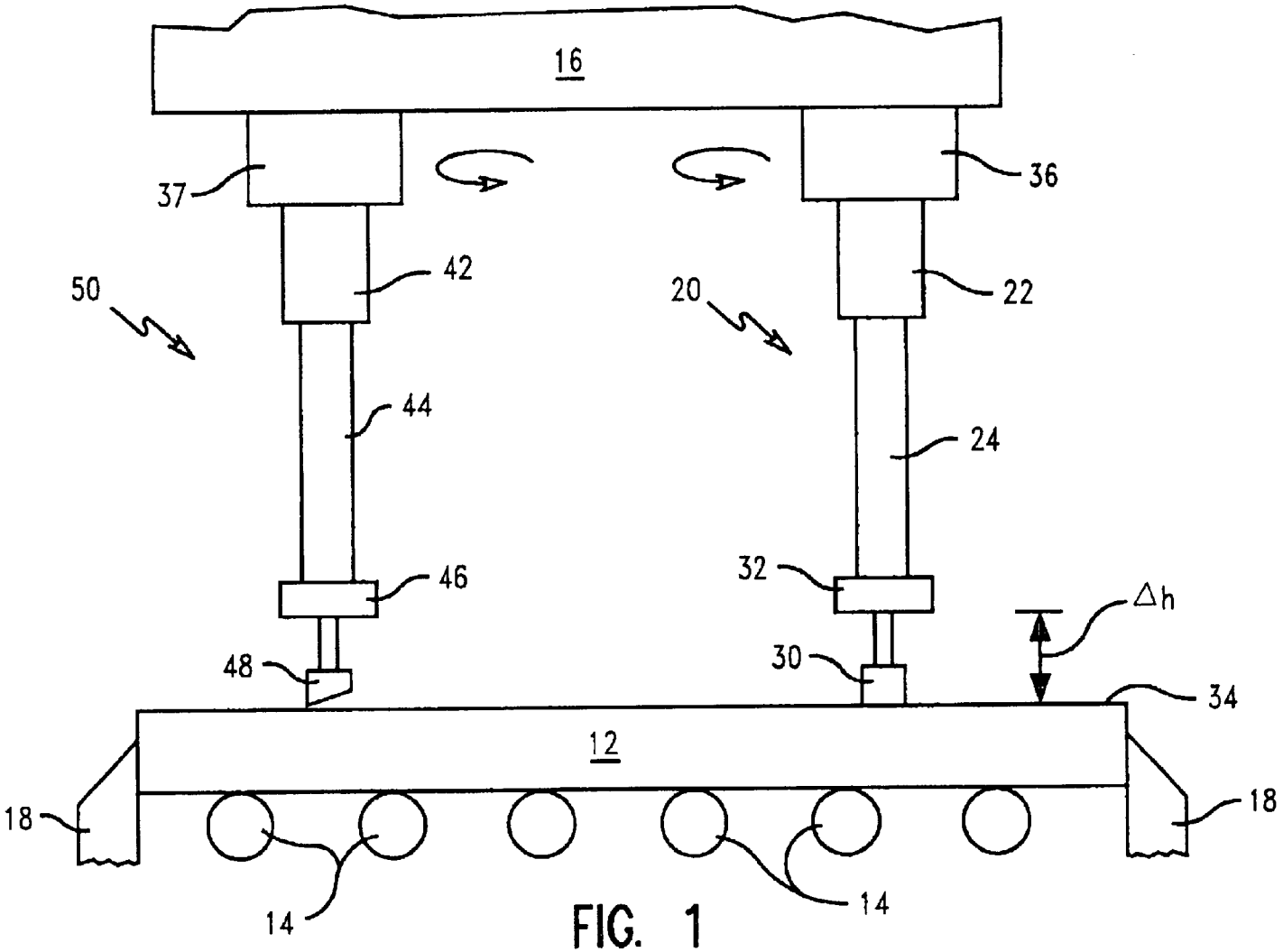
FIG. 1 is a side elevational view of the preferred system of the present invention for removing material from, and polishing the backside surface of a microprocessor chip or die.

In describing the preferred embodiment of the present invention, reference will be made herein to FIGS. 1 and 2 of the drawings in which like numerals refer to like features of the invention. Features of the invention are not necessarily shown to scale in the drawings.

The present invention is useful to uniformly thin the backside of microprocessor chips or dies, particularly large microprocessor chips of at least 15 mm by 15 mm size involving flip chip packaging, i.e., where the integrated circuit is mounted face down with controlled collapsed chip connector (C4) solder ball input/output connector contacting the surface of a ceramic substrate. In the latest designs, the chip size can exceed 30 mm by 30 mm. The preparation of the chip or die is typically for backside emission microscopy for the identification, redesign and process improvements to functioning or non-functioning integrated circuits, e.g., functional characterization of logic integrated circuits for design debug, earlier hardware functionality, reliability qualification assurance, and manufacturing yield learning analysis. In such preparation, it is necessary to remove a desired depth of material from the chip or die backside.

As shown in FIG. 1, a microprocessor chip or die 12 is mounted in a fixed position in a fixture 18 with the connector side containing solder balls 14 or other connectors (e.g., wire bonds or the like) facing downward and the opposite, backside 34 facing upward. The die backside is typically a layer of single crystal silicon, and may also contain plastic packaging material. A conventional diamond fly cutter 50 is mounted in a rotatable chuck 37 of a numerical controlled (NC) milling machine 16. Cutter 50, such as that available from Hypervision, Inc. of Fremont, Calif., consists of a spindle rigidly connected to an arm 44, which in turn receives diamond cutter 48 mounted on a mandrel and secured by nut 46. Cutter 50 is used to remove the majority of the die 12 backside surface 34, which may be decreased in thickness, $\Delta h$, from about 750 $\mu$m to about 100 $\mu$m or less during the milling and polishing process. The present invention may be used to thin the backside of individual chips or dies, as well as to thin an entire semiconductor wafer containing numerous chips or dies.

Since such a NC milling process leaves undesirable marks and scratches, the present invention provides a polishing method and tool to remove and/or reduce such marks and scratches. Polishing tool 20 comprises a spindle 22 received in chuck 36, and arm 24 securing polishing pad 30. However, instead of having a rigid series of connections between the polishing pad 30 and chuck 36, the present invention instead utilizes a flexible, constant force actuation (discussed further below) to control the polishing process.

Polishing tool 20 is rotated by chuck 36 of NC milling machine 16 in the direction of the arrow at a desired speed, e.g., from about 500–2000 rpm, more preferably about 1500 rpm, depending on the desired surface characteristics and roughness desired. As a polishing slurry, the present invention preferably utilizes deionized water containing an inert diamond and/or aluminum oxide particulate slurry polishing grit materials. The particles may vary in diameter from about 0.05 $\mu$m to about 20 $\mu$m, depending on the polishing process step. Typically, the polishing time is less than 2 hours, which is significantly faster than alternative methods of chemical-mechanically polishing or uncontrollable wet chemical etch methods. The present invention also uses more environmentally friendly slurries, instead of the acid/basic CMP slurries or the chlorine or bromine chemicals in laser chemical machining. Furthermore, existing etch chemistries used in laser chemical machining are limited to silicon removal only. No etch chemistries exist for laser chemical machining to remove silicon oxide film involved in SOI technologies. The present invention also removes the SOI layer and silicon nitride layer to permit direct access to the active implanted silicon regions of the devices.

Polishing tool 20 typically leaves minimal surface roughness, i.e., about 10 microns RMS or less, preferably polished to within ±1–2 microns surface roughness, over the entire die backside surface. This surface finish planarity and uniformity is necessary for infrared wavelength of photons from electron hole pairs.

Figure 2:
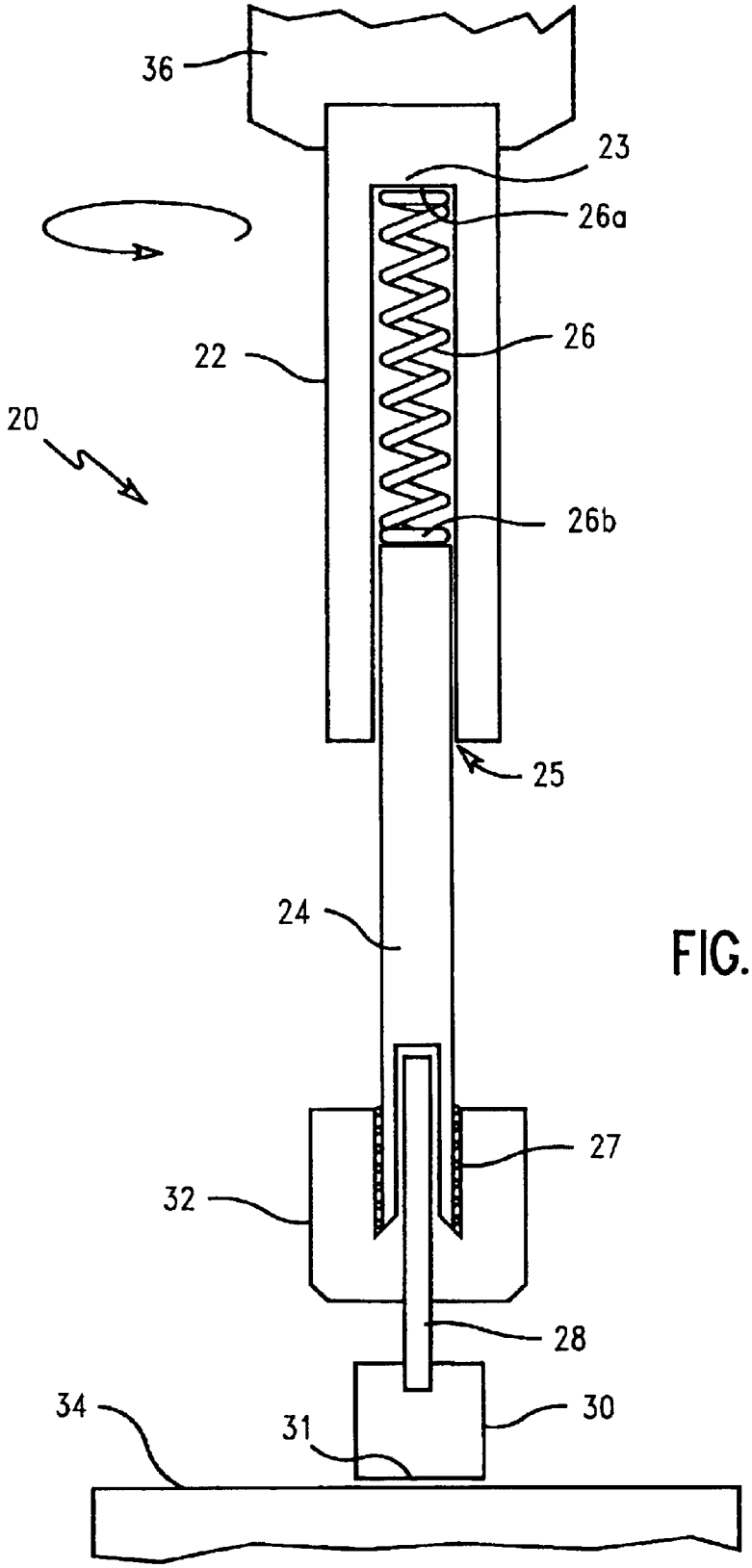
FIG. 2 is an elevational view, partially in cross-section, of a preferred tool of the present invention shown in FIG. 1, comprising a spindle housing, constant force spring actuator, and polishing pad.

FIG. 2 depicts the preferred polishing tool 20 of the present invention. Spindle housing 22 is hollow and open at lower end 25 to slideably receive arm 24, which is then movable up and down with respect to the housing. At a lower end of arm 24 is a threaded split end 27 which grasps a metal rod or shaft 28, the lower end of which is secured to a relatively hard felt polishing pad 30. A threaded nut 32 is screwed onto the complimentary threaded arm lower end 27 to secure rod 28 and pad 30. The lower end 31 of the polishing pad is resilient and adapted to contact and polish the chip backside surface 34. To maintain an essentially constant force on the polishing pad against the semiconductor die, a constant force actuator 26, here a compressible spring, is disposed within spindle housing 22. Instead of a mechanical spring, the constant force actuator may be a hydraulically or electrically controlled actuator. The upper end 26*a* of the actuator spring is urged against the upper end 23 of the spindle and the lower end 26*b* of the spring is urged against the upper end of arm 24, forcing the arm downward. The constant force actuator or spring is selected to maintain the desired force of the deformable polishing pad against the die surface as the felt polishing pad wears.

In operation, one or more dies are mounted in a fixture and a diamond fly cutter of the type described above is used to remove the majority of the desired depth of material from the die backside. The polishing tool of the present invention is then employed, in conjunction with a desired polishing slurry, at a desired essentially constant pressure, to traverse the die backside and remove the cutter tool marks to a desired surface roughness. Once the backside is thinned the desired amount, the die may then be subject to backside analysis techniques, such as by emission microscopy.

The method of the present invention is particularly useful for polishing dies having silicon layers incorporating silicon oxide insulator (SOI) layers of silicon oxide as well as silicon germanium materials with buried SOI layers. The laser chemical machining method is limited in that no etch chemistries exist to remove the silicon oxide layer from the die backside for image-based electrical characterization and analysis. The polishing method and tool of the present invention do not develop the heat or reactive chemistries that might affect the non-silicon packaging materials on the die backside. Such non-silicon packaging materials include plastics and metals. The present invention reduces or eliminates degrading of the wire-bonded integrity, affecting the chip metal interconnections, reaction with lead/tin C4 solder metallurgy, or affecting the copper alloy wire bond backplane materials. The constant force of the polishing fixture over the die surface produces a uniformly planar surface finish that compensates for non-planar die placement within a plastic quad flat pack type of package, and for manufacturing deficiencies that occur when a metal alloy wire bond backplane shifts within a plastic package material during curing.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for preparing a semiconductor die for analysis comprising:

providing a semiconductor die having a connector on one side and an opposite, backside surface to be analyzed;

providing a polishing pad for polishing the backside surface of a semiconductor die;

providing a rotatable spindle for securing the polishing pad;

providing a constant force actuator on the spindle, said constant force actuator being adapted to provide constant force between the polishing pad and the backside surface of the die;

contacting the backside die surface with the polishing pad;

rotating the spindle and polishing pad; and polishing the backside surface of the die while maintaining the substantially constant force of the polishing pad on the die backside surface with the constant force actuator.

2. The method of claim 1 wherein the backside of the die comprises silicon, and wherein the polishing removes portions of the silicon.

3. The method of claim 1 wherein the backside of the die contains silicon oxide.

4. The method of claim 1 wherein the backside of the die contains silicon nitride.

5. The method of claim 1 wherein the backside of the die contains silicon germanium.

6. The method of claim 1 wherein, prior to polishing the die backside with the polishing pad, the method includes milling the die backside to remove a desired thickness of the die.

7. The method of claim 1 further including analyzing the polished backside of the die by emission microscopy.

8. The method of claim 1 wherein the spindle and polishing pad are rotated at a speed of about 500 to 2000 rpm during polishing.

9. The method of claim 1 wherein the polishing pad is resilient and deformed during polishing.

10. The method of claim 1 further including applying a non-reactive slurry between the polishing pad and the die surface during polishing.

11. The method of claim 1 wherein the semiconductor die is secured in a stationary position in a fixture.

12. A method for polishing a semiconductor surface comprising:

providing a semiconductor having a surface to be polished;

providing a polishing pad for polishing the semiconductor surface;

providing a rotatable spindle for securing the polishing pad;

providing a constant force actuator on the spindle selected from the group consisting of a mechanically controlled actuator, a hydraulically controlled actuator and an electrically controlled actuator;

said constant force actuator applying a constant force from the spindle to the polishing pad and urging the polishing pad against the semiconductor surface;

rotating the spindle and polishing pad; and polishing the semiconductor surface of the semiconductor while maintaining the substantially constant force of the polishing pad on the semiconductor surface with the constant force actuator.

13. The method of claim 12 wherein the semiconductor surface comprises silicon and, additionally, a material selected from the group consisting essentially of silicon oxide, silicon nitride and silicon germanium, and wherein the polishing removes portions of the silicon and the material.

14. The method of claim 12 wherein, prior to polishing the semiconductor surface with the polishing pad, the method includes milling the semiconductor surface to remove a desired thickness of the semiconductor.

15. The method of claim 12 further including analyzing the polished semiconductor surface by emission microscopy.

16. The method of claim 12 wherein the spindle and polishing pad are rotated at a speed of about 500 to 2000 rpm during polishing.

17. The method of claim 12 wherein the polishing pad is resilient and deformed during polishing.

18. The method of claim 12 further including applying a non-reactive slurry between the polishing pad and the semiconductor surface during polishing.

19. The method of claim 1 wherein the constant force actuator comprises a mechanically controlled actuator.

20. The method of claim 1 wherein the constant force actuator comprises an electrically controlled actuator.

21. The method of claim 1 wherein the constant force actuator comprises a hydraulically controlled actuator.

22. The method of claim 1 wherein the constant force actuator comprises a spring.

23. A method for polishing a semiconductor surface comprising:

providing a semiconductor having a surface to be polished;

providing a polishing pad for polishing the semiconductor surface;

providing a rotatable spindle for securing the polishing pad;

providing a constant force actuator on the spindle;

said constant force actuator applying a constant force from the spindle to the polishing pad and urging the polishing pad against the semiconductor surface;

rotating the spindle and polishing pad; and polishing the semiconductor surface while maintaining the substantially constant force of the polishing pad on the semiconductor surface with the constant force actuator, wherein the semiconductor surface comprises silicon and, additionally, a material selected from the group consisting essentially of silicon oxide, silicon nitride and silicon germanium, and wherein the polishing removes portions of the silicon and the material.

* * * * *